US007427176B2

(12) United States Patent
Persson et al.

(10) Patent No.: US 7,427,176 B2
(45) Date of Patent: Sep. 23, 2008

(54) VIBRATORY PLATE

(75) Inventors: Gert Persson, Lyckeby (SE); Gunnar Hedlund, Karlskrona (SE)

(73) Assignee: Dynapac Compaction Equipment AB, Karlskrona (SE)

( * ) Notice: Subject to any disclaimer, the term of this patent is extended or adjusted under 35 U.S.C. 154(b) by 0 days.

(21) Appl. No.: 11/819,762

(22) Filed: Jun. 29, 2007

(65) Prior Publication Data

US 2008/0003058 A1 Jan. 3, 2008

(30) Foreign Application Priority Data

Jul. 3, 2006 (SE) ..... 0601448

(51) Int. Cl.
*E01C 19/32* (2006.01)
*E01C 19/35* (2006.01)

(52) U.S. Cl. ..... 404/133.1; 404/113; 404/133.05; 239/159

(58) Field of Classification Search ..... 404/113, 404/133.05, 133.1; 239/159
See application file for complete search history.

(56) References Cited

U.S. PATENT DOCUMENTS 3,064,904 A * 11/1962 Roberts ..... 239/754
3,416,417 A 12/1968 McIlrath et al.
4,113,403 A * 9/1978 Tertinek et al. ..... 404/113
4,421,435 A * 12/1983 Zemke et al. ..... 404/113
5,222,828 A * 6/1993 Magalski ..... 404/103
5,890,834 A 4/1999 Waldenberger
5,934,825 A 8/1999 Waldenberger
5,957,622 A * 9/1999 Vera-Montiel ..... 404/133.1
6,379,082 B1 4/2002 Takemoto
7,140,804 B2 * 11/2006 Gregg ..... 404/93

FOREIGN PATENT DOCUMENTS

GB 2 275 954 9/1994

OTHER PUBLICATIONS

Operation & Parts Manual, "Multiquip Mikasa Series Model MVC-88GH/GHW One-Way Plate Compactor (Honda Gasoline Engine)", Revision #4 (Oct. 15, 2004), pp. 1 and 13.

* cited by examiner

*Primary Examiner*—Raymond W Addie
(74) *Attorney, Agent, or Firm*—Walter Ottesen

(57) ABSTRACT

A vibratory plate includes a sprinkler device (3) for wetting the underside of a base plate (2) of the vibratory plate (1). The vibratory plate also includes a water tank (4) and the sprinkler device (3) has an outlet (8) for passing the water, a valve (11) to control the release of water and a knob (5) for the operation of the valve. A channel (6) guides the released water and is arranged along the front edge of the base plate (2). The channel (6) is arranged with descending inclinations along and from the middle of its length and to both side edges of the base plate (2). The outlet (8) is only arranged for the release of water to the middle of the channel (6).

11 Claims, 4 Drawing Sheets

VIBRATORY PLATE

CROSS REFERENCE TO RELATED APPLICATION

This application claims priority of Swedish patent application no. 0601448-4, filed Jul. 3, 2006, the entire content of which is incorporated herein by reference.

FIELD OF THE INVENTION

The invention relates to a vibratory plate having a sprinkler device. The sprinkler device is less sensitive to impurities than previously known devices and is therefore more operationally reliable. The sprinkler device is also operated with better ergonomics than previously known devices. The device is suitable for light vibration plates used for the compaction of asphalt, gravel, stones, soil or macadam.

BACKGROUND OF THE INVENTION

During vibratory compaction of asphalt with a vibratory plate, the underside of the base plate is continually wetted to avoid the adhesion of asphalt. Water is normally used for this wetting, however, emulsions can also be used. On page 13 of the manual: "Mikasa SERIES MODEL MVC-88GH/GHW ONE-WAY PLATE COMPACTOR", "Revision #4 (Oct. 15, 2004)", a vibratory plate is shown with a sprinkler device. The base plate (position 7) of the vibratory plate is provided with a channel at the front (position 9, "splash plate"), with a length along the front edge of the base plate. The length of the channel is discontinued in the middle by an protruding eccentric housing (position 8). The water tank (position 11) of the sprinkler device has an outlet at the bottom (position 9, "water tube") which is arranged for release of water to both sections of the channel and for release in the middle on the protruding eccentric housing. The total opening area for the outlet is in this case allocated to a minimum of three openings, and therefore the separate opening areas are very small. This can cause the outlet to become very easily blocked by impurities in the water. In such circumstances it is complicated to flush the outlets without extensive dismantling. The sprinkler device basically corresponds with the device shown in the U.S. Pat. No. 6,379,082. In FIG. 2 of this patent, it is shown how the outlet can be opened and closed with a valve 15. The knob of the valve is connected to the valve and is placed at the same level as the bottom of the tank. From an ergonomic point of view this is not a good position for the knob because the operator has to bend down a long distance to reach the knob. There is a considerable risk that the operator will operate the valve by kicking the knob instead of bending down and in so doing damage the knob or adjacent components. The positioning and execution also make it difficult for the operator to regulate the quantity of water released. There is a considerable risk that the operator will not regulate the quantity of the water to be released to what is actually needed and will instead open the valve completely. The result of this is that an unnecessary amount of time must be used to refill the tank with water.

SUMMARY OF THE INVENTION

It is an object of the invention to provide a vibratory plate incorporating a sprinkler device that solves the above described problems. This is achieved in that the water outlet of the sprinkler is arranged for the release of water only to the middle of the channel and therefore only needs to comprise one or two openings. The total opening area of the outlet is allocated to a smaller number of openings than in known sprinkler devices and the individual openings are therefore designed with the largest possible area. The risk of blockage is accordingly minimized. The openings are integrated in the valve and can easily be flushed if necessary. The released water is guaranteed to be distributed along the entire length of the channel in that the channel is arranged at an angle. The operator can easily reach the valve knob with one hand without fully releasing the control handle with the other hand because the knob is placed on the top of the tank. Regulating the release of water is also simplified in that it is arranged in steps perceptible for the operator.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
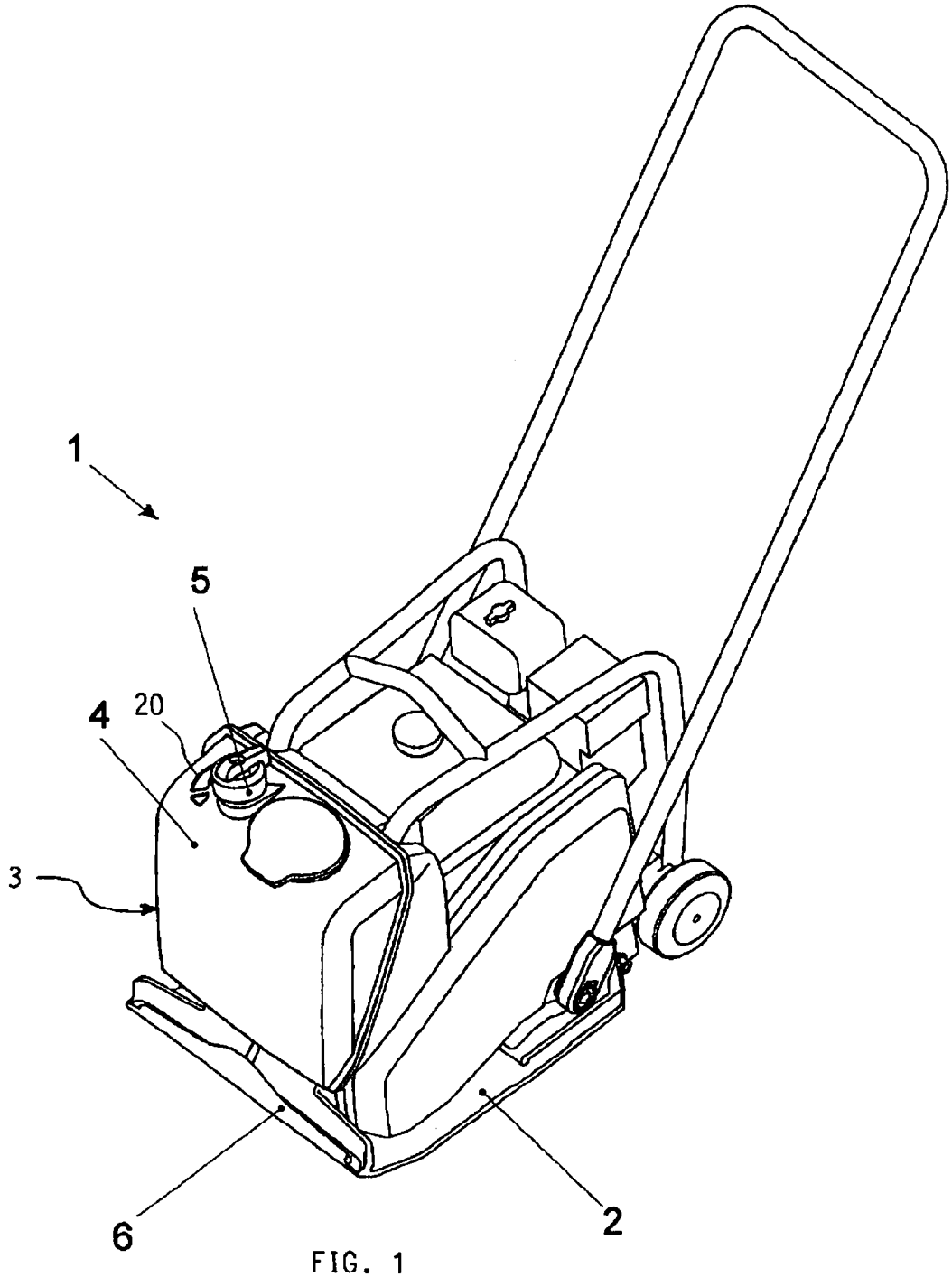
FIG. 1 is a perspective view of a vibratory plate provided with a sprinkler device in accordance with the invention.

FIG. 1 shows a vibratory plate 1 with a base plate 2. The base plate 2 can be brought to vibrate to compact the underlying surface and to drive the vibratory plate 1 forward. The sprinkler device 3 is placed at the front of the vibratory plate 1 and comprises a water tank 4, a knob 5 and a channel 6 extending along the front edge of the base plate 2. The sprinkler device 3 also comprises a valve 11, a valve stem extension 12 and an outlet 8 for water shown in FIG. 2. The release of the water is controlled by the valve 11. The valve 11 is operated with the knob 5 via the valve stem extension 12 and can be actuated to close, open and regulate the release of water to the channel 6. When the released water reaches the channel 6, it is distributed along the entire length of the channel. The vibrations in the base plate 2 cause the water to be finely separated into droplets that gradually slide over the front wall of the channel 6 to the underside of the base plate 2 in the intended manner. The knob 5 is arranged on the top of the water tank 4 and can easily be reached and operated by the operator under acceptable ergonomic conditions. A recessed arrow 20 on the top of the water tank 4 shows the operator in which direction the valve 11 is opened. The water tank 4 is made in injection molded plastic and holds 15 liters. The water tank 4 is designed to be removable, and can be provided with a handle, to simplify the filling of water and its replacement.

Figure 2:
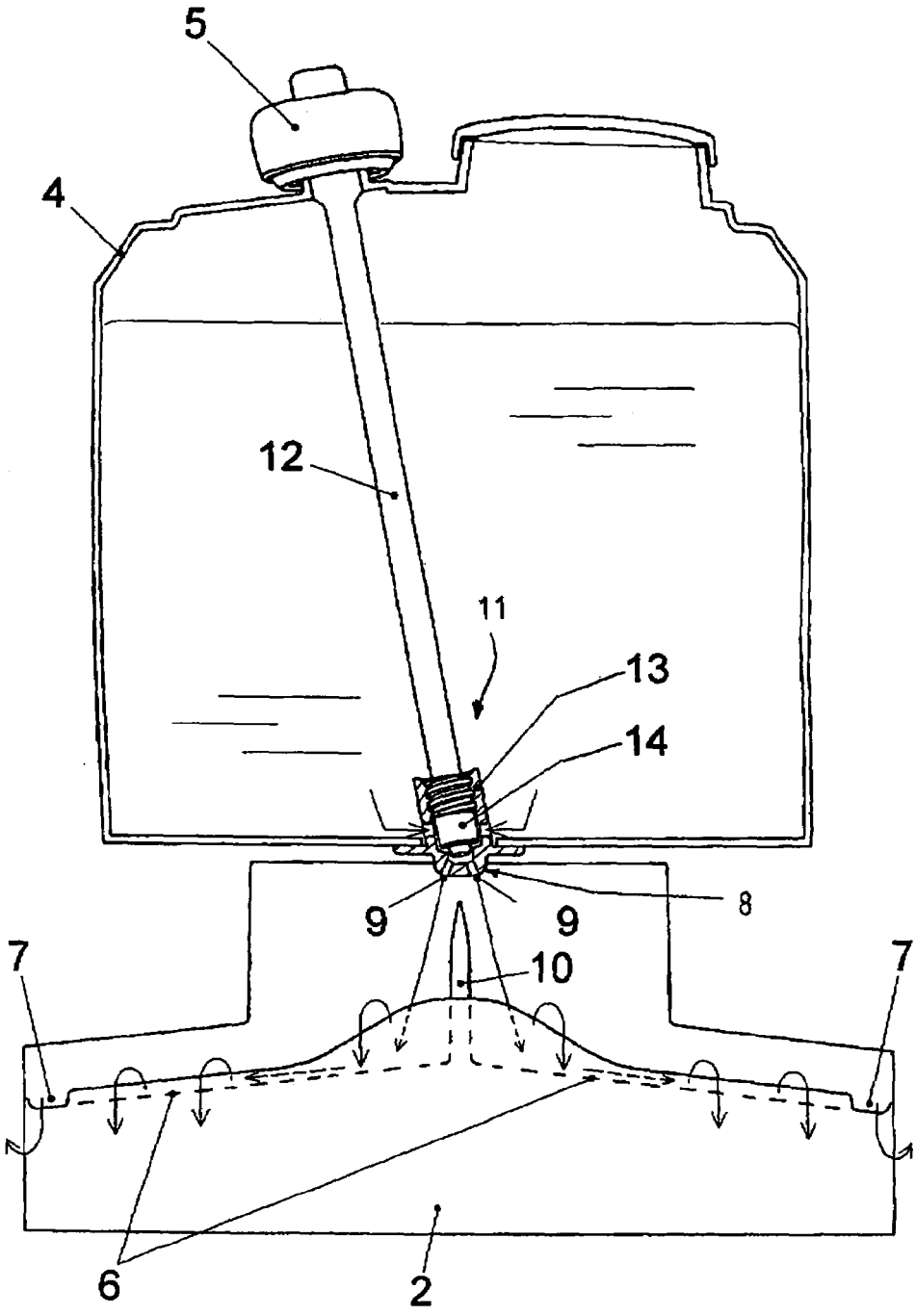
FIG. 2 is a front elevation view, partially in section, of the sprinkler device of FIG. 1.

FIG. 2 shows how the channel 6 is arranged with descending inclinations along and from the middle of its length and to both side edges of the base plate 2. It is appropriate to design the channel 6 with descending slopes of 7 degrees from the horizontal plane. This ensures that the released water is distributed along the entire length of the channel 6 when the water is only released from the middle of the length of the channel 6. The channel 6 is arranged to have varying depths. The depth of the channel 6 is at a maximum in the middle of its length and then successively declines to become constant towards the end of the length. The depth is arranged to vary by means of a varying configuration of the height of the front wall of the channel 6. The height of the front wall of channel 6 is adjusted so that the same quantity of water passes over each part of its length.

Figure 3:
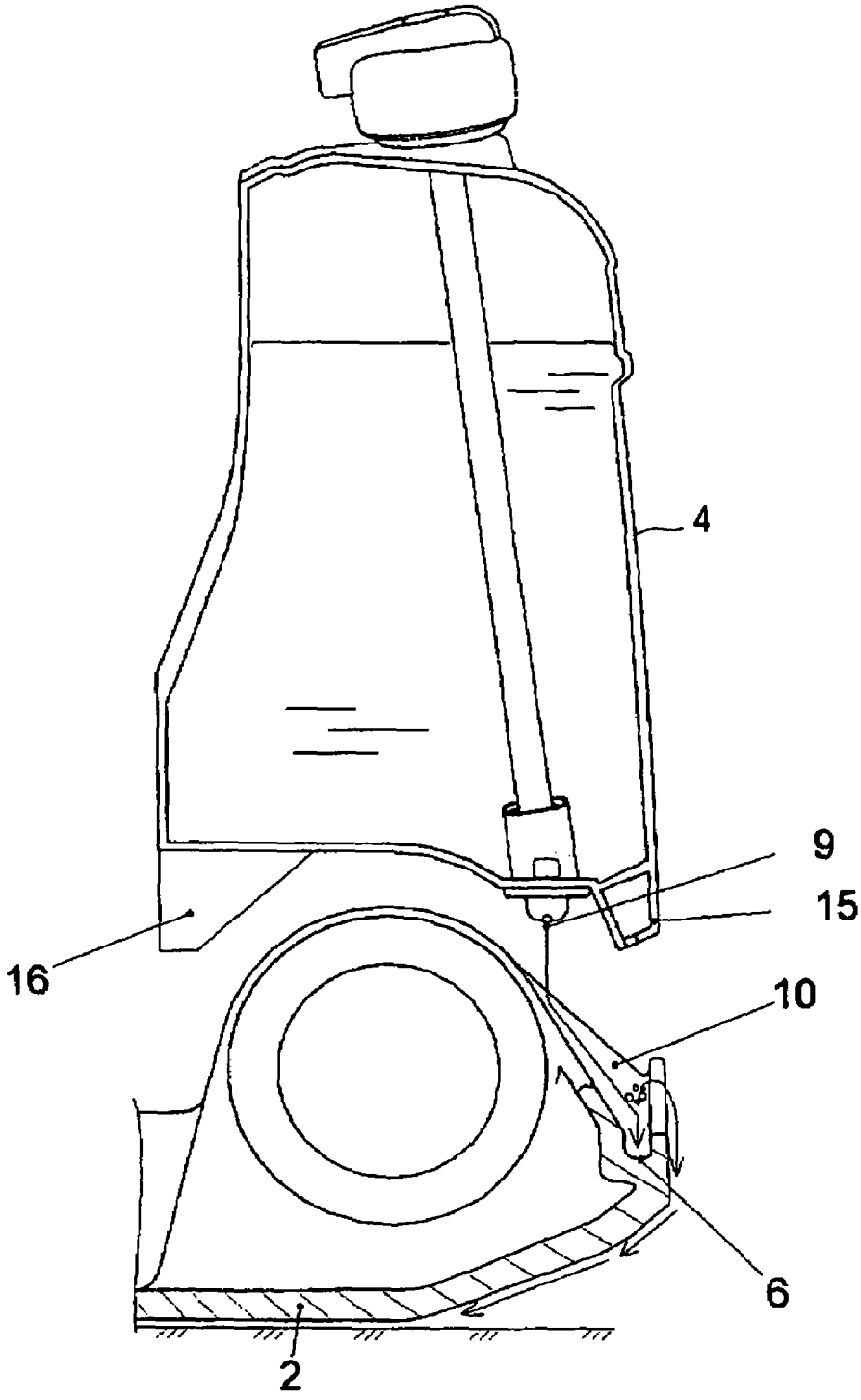
FIG. 3 is a side elevation view, in section, of the front portion of the sprinkler device of FIGS. 1 and 2; and, FIG. 4 shows an enlarged section of a knob incorporated in the sprinkler device of FIGS. 1 to 3, seen from above.

The flow of water is illustrated in FIG. 2 with curved arrows over the front wall of the channel 6. This ensures the optimum use of the released quantity of water while the underside of the base plate 2 is guaranteed to receive a uniformly distributed wetting. The adjustment has the effect that the height of the front wall is maximized at the middle of its length because water collects there as a result of the release. The rear wall of the channel 6 has a height that ensures that no water can pass over its edge. The channel can also be arranged with a constant depth. The consumption of water will then be somewhat higher than is the case with the above described adjustment of its depth. The channel 6 is arranged as open at the ends by virtue of notches or gaps 7 in its front wall. The function of the gaps 7 is to release the water so that it reaches the side edges of the base plate 2. (The release of water is illustrated in FIG. 2 with curved arrows towards the side edges of the base plate 2.) The gaps 7 also simplify cleaning of the channel 6 and eliminate the risk of frost damage when the vibratory plate 1 is not in use. The base plate 2 is of cast iron and the channel 6 is integrated into the base plate as shown in FIG. 3. It is also possible to arrange the channel as a separate part and to connect it with the base plate in a different way.

The outlet 8 is arranged to release water to the middle of the length of channel 6. In the preferred embodiment shown, the outlet 8 comprises two openings 9 which are arranged to release the water to the middle of the length of the channel 6. The channel 6 comprises a thin partition wall 10 in the middle of and across its length. The two openings 9 are arranged for the release of water to respective sides of the partition wall 10 as shown by the straight arrows in FIG. 2. The distance between the openings 9 can be increased by more than is shown in FIG. 2. If the distance is increased too much, however, there is a risk that there will be too little water at the middle of the channel 6. It is also possible to exclude the partition wall and to allow the outlet 8 to only comprise one opening 9 arranged for release to the center of the length of the channel 6. The sprinkler device 3 will then have a somewhat inferior operation when the vibratory plate is used under side inclinations on sloping surfaces.

The valve 11 is arranged in the bottom of the water tank 4. It is operated with the knob 5 which is arranged on top of the water tank 4 and is connected to the valve 11 via the valve stem extension 12. The valve stem extension 12 is rotatable and is disposed within a passage in the roof of the water tank 4. The valve 11 comprises a valve body 13 and a valve cone 14 which is arranged as threaded in the valve body 13. The two openings 9 of the outlet 8 are arranged in the valve body 13 and are designed as circular ducts with a diameter of 3.5 millimeters. The ducts open into a hollow space inside the valve body 13. The bottom of the valve cone 14 can just be accommodated in the hollow space in the valve body 13 when the valve 11 is closed. The valve 11 is shown in a slightly opened position in FIG. 2. The valve 11 has been opened as a result of the operator turning the knob 5 counterclockwise. The turning movement has been transferred via the valve stem extension 12 to the valve cone 14. The valve cone 14 has then, as a result of its threaded connection with the valve body 13, been upwardly displaced somewhat in the axial alignment of the valve stem extension 12. The displacement causes an aperture to form between the valve cone 14 and the hollow space of the valve body 13 which, in turn, allows the water to flow into the valve body 13 (the flow is illustrated with the angled arrows in FIG. 2) and out through the openings 9. The pitch of the thread, geometry of the cone and open area of the openings 9 are adjusted so that the flow is approximately one liter/minute when the valve 11 is half open and the water tank 4 is half full. When the water tank 4 is completely full, the outflow is slightly higher for this valve setting as a result of the higher static pressure head. To conserve the water, the operator can select to regulate the flow down by slightly turning the knob 5 clockwise. The operator can, in the opposite way, compensate for the lower static pressure head that arises just before the tank is empty. Above the valve cone 14 there is an O-ring which closes and seals the outlet 8 when the operator has turned the knob 5 clockwise and fully closed the valve 11. The valve 11, valve stem extension 12 and knob 5 are designed in injection molded plastic and the valve body 13 is connected to the water tank 4 by welding.

The outlet 8 can be easily and effectively cleaned by fully unscrewing the valve cone 14 from the valve body 13 and pulling it through the passage for the valve stem extension 12 in the roof of the water tank 4, together with the knob 5 and valve stem extension 12. The outlet 8 and valve body 13 can then be flushed internally via the passage or refill opening on the water tank.

FIG. 3 shows the sprinkler device 3 of FIG. 2 seen from the left and the release of water from the left opening 9 of the outlet 8 just in front of the partition wall 10. (The release of water is illustrated with the angled arrow in FIG. 3.) The released water is released on the rear wall of the channel 6 and is finely dispersed to drops of water as a result of the vibration of the base plate 2 and flows down in the bottom of the channel 6. (The water droplets are illustrated with small circles in FIG. 3.) The droplets continue to flow down and along the inclined bottom of the channel 6 at the same time as some of the droplets slide over the front wall of the channel 6 (illustrated with curved arrow in FIG. 3) as a result of the vibration of the base plate 2. The water then follows the underside of the base plate 2 (illustrated with straight arrow in FIG. 3) and forms a thin film between the base plate 2 and underlying surface in the intended manner.

The water tank 4 is arranged to be detachable and comprises a supporting edge 15, which is aligned along the bottom front edge of the tank. When the water tank 4 is detached from the vibratory plate and set down, for example, to be filled, the supporting edge 15 constitutes, together with a foot 16 formed on the water tank 4, support points. The supporting edge 15 and foot 16 have heights that ensure that the outlet 8 is not damaged or blocked by impurities when the water tank 4 is set down. The supporting edge 15 also functions as a windshield in front of the outlet 8.

The rear wall of the channel 6 can be provided with inclined grooves or furrows to lead the released water out from the side of the base plate. (Not shown in FIG. 3.) This supplements the function of the channel and improves the function of the sprinkler device when the vibratory plate is used under large side inclination.

Figure 4:
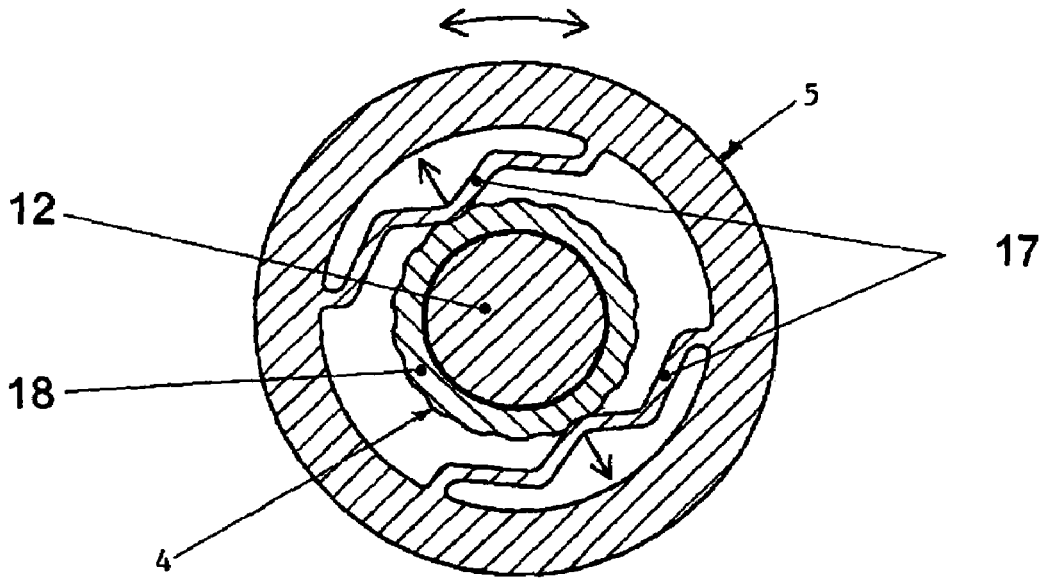

FIG. 4 shows the knob 5 with a pair of toothed segments 17. The toothed segments 17 are in contact with a toothed rim 18 which is arranged round the knob's 5 center of rotation and internally connected to the passage for the valve stem extension 12 in the roof of the water tank 4. The knob 5 is shown in a rotated position that corresponds to a particular position in a series of steps. The teeth of the toothed segments 17 are then engaged with the toothed rim 18. This engagement means that the knob 5 is subject to a higher rotational resistance in these rotational positions than in the rotational positions between the steps. When the operator turns the knob 5 in one of the directions of rotation (illustrated with curved double arrow in FIG. 4) the toothed segments 17 give way (illustrated with straight arrows in FIG. 4) and permit a transition to the adjoining step. The operator thus receives a perceptible indication of how long, that is, how many steps, the knob 5 is turned in different directions of rotation. The teeth of the segments 17 and the rim 18 have a rounded, low profile and form a wave-form pattern. The profile, height and number of teeth must be adjusted so that a distinct division into steps is achieved. They must also be adjusted so that the set rotational position is maintained during the operation of the vibratory plate. It is also possible to design the teeth with a more cog-like and higher profile to achieve a higher rotational resistance and more distinct steps.

The knob 5 and the valve 11 are, as previously mentioned, arranged on the top of the water tank 4 and in the bottom of the water tank 4, respectively. The definition "on the top of the water tank 4" refers in principle to all arrangements that enable the knob 5 to be placed above the water level obtained when the water tank 4 is completely filled with water. The definition "in the bottom of the water tank 4" refers in principle to all arrangements that enable most of the water in the water tank 4 to pass the valve 11 by natural pressure.

It is understood that the foregoing description is that of the preferred embodiments of the invention and that various changes and modifications may be made thereto without departing from the spirit and scope of the invention as defined in the appended claims.

What is claimed is:

1. A vibratory plate comprising:

a base plate having an underside and having a front edge and first and second side edges;

a water tank mounted above said base plate;

a sprinkler device for wetting said underside of said base plate; and, said sprinkler device including:

a channel disposed along said front edge for guiding water released from said tank;

said channel having a mid elevation and first and second side elevations at respective ones of said side edges of said base plate;

said side elevations being lower in elevation than said mid elevation;

said channel including a first channel segment sloping downwardly from said mid elevation to said first side elevation and a second channel segment sloping down from said mid elevation to said second side elevation; and, a valve assembly for passing water from said tank into said channel at said mid elevation thereof.

2. The vibratory plate of claim 1, wherein said valve assembly includes an outlet for directing the water from said tank to said channel; a valve to control the release of the water from said tank; and, an operator-controlled knob connected to said valve to enable an operator to adjust said valve.

3. The vibratory plate of claim 2, wherein said outlet is arranged only for the release of water to the middle of said channel at said mid elevation.

4. The vibratory plate of claim 2, wherein said channel is arranged with a varying depth along said first and second channel segments.

5. The vibratory plate of claim 2, wherein said channel is open at said first and second side elevations.

6. The vibratory plate of claim 2, wherein said outlet defines one opening.

7. The vibratory plate of claim 2, wherein said channel has a thin partition wall extending transversely thereacross; and, said outlet has two openings arranged to direct water to respective sides of said partition wall.

8. The vibratory plate of claim 2, wherein said valve is arranged in the bottom of the water tank and said knob is mounted on the top of said water tank; and, said valve assembly includes a valve stem connecting said knob to said valve.

9. The vibratory plate of claim 8, wherein said valve includes a valve body and a valve cone; said valve cone is threadably arranged in said valve body and said outlet is arranged in said valve body.

10. The vibratory plate of claim 8, further comprising:

a toothed rim fixedly disposed in surrounding relationship to said valve stem; and, said knob having toothed segments in meshed engagement with said toothed rim so as to provide a perception to an operator as to the rotational position of said knob and degree of opening of said valve as said knob is rotated.

11. The vibratory plate of claim 2, wherein said channel has a thin partition wall extending transversely thereacross; and, said outlet has only two openings arranged to direct water to respective sides of said partition wall.

* * * * *